US005186249A

United States Patent [19]

Bhatti et al.

[11] Patent Number: 5,186,249

[45] Date of Patent: Feb. 16, 1993

[54] HEATER CORE

[75] Inventors: Mohinder S. Bhatti, Amherst; Prasad S. Kadle, Getzville, both of N.Y.

[73] Assignee: General Motors Corporation, Detroit, Mich.

[21] Appl. No.: 894,975

[22] Filed: Jun. 8, 1992

[51] Int. Cl.[5] ..... F28F 13/06

[52] U.S. Cl. ..... 165/174; 165/176

[58] Field of Search ..... 165/153, 174, 176

[56] References Cited

U.S. PATENT DOCUMENTS

| | | | |
|---|---|---|---|
| 1,344,351 | 6/1920 | Norelius et al. | 165/174 X |
| 1,673,409 | 6/1928 | Kelley | 165/174 |
| 1,802,930 | 4/1931 | Seefert | 165/174 X |
| 2,602,647 | 7/1952 | Miller | 165/174 X |
| 3,351,131 | 11/1967 | Berthold | 165/159 |
| 3,734,176 | 5/1973 | Hagnauer | 165/158 |
| 3,759,319 | 9/1973 | Ritland et al. | 165/111 |
| 4,047,562 | 9/1977 | Weber | 165/111 |
| 4,223,722 | 9/1980 | Shade, Jr. | 165/111 |
| 4,520,867 | 6/1985 | Sacca et al. | 165/144 |
| 4,549,605 | 10/1985 | Sacca et al. | 165/150 |
| 5,000,259 | 3/1991 | Forrest | 165/176 |
| 5,029,637 | 7/1991 | Brücher et al. | 165/119 |

*Primary Examiner*—Allen J. Flanigan
*Attorney, Agent, or Firm*—Patrick M. Griffin

[57] ABSTRACT

A heater core includes an inlet tank, a return tank, and an outlet tank. A plurality of parallel inlet flow tubes extend from the inlet tank to the return tank. A plurality of outlet flow tubes extend parallel to the inlet flow tubes between the return tank and the outlet tank. Corrugated cooling fins are disposed between adjacent inlet and outlet flow tubes. A perforated inlet baffle plate is disposed angularly within the inlet tank. The inlet baffle plate has a calculated angular orientation, length, and spacing within the inlet tank. An unperforated return baffle plate is disposed in the return tank. The return baffle plate has a calculated length and spacing within the return tank. The inlet baffle plate and return baffle plate provide uniform coolant flow through the plurality of inlet and outlet flow tubes.

5 Claims, 3 Drawing Sheets

PRIOR ART

HEATER CORE

TECHNICAL FIELD

The subject invention relates to automotive heat exchangers, and more particularly to an automotive heater core having strategically located flow control baffles for uniform coolant flow.

BACKGROUND ART

For mobile applications, e.g., automobiles, heat exchangers are used in various capacities to dissipate or absorb heat energy from a circulated fluid. For example, most conventional liquid cooled internal combustion engines include a radiator and a heater core for dissipating heat energy generated by the automotive engine.

Heater cores, in particular, are provided with a tubular inlet port centered along a flow axis for receiving high temperature fluid from a heat source, namely the automotive engine. An inlet tank having a predetermined height and a predetermined length and at least one wall spaced from the flow axis receives high temperature fluid from the inlet port. Hence, hot fluid from the engine enters the heater core through the inlet port and is directed immediately into an inlet tank. A plurality of flow tubes extend from the inlet tank for dissipating heat energy from the fluid. In this manner, the flow of high temperature fluid is divided among the various flow tubes and carried away from the inlet tank so as to dissipate heat energy from the fluid. An outlet tank is provided for receiving low temperature fluid from the various flow tubes. Therefore, the plurality of flow tubes all communicate with a common outlet tank and deliver low temperature fluid to the outlet tank to be returned to the heat source through a tubular outlet port extending from the outlet tank.

A major deficiency of the prior art heater cores is that the rate of fluid flow through the various flow tubes is highly nonuniform between the inlet tank and the outlet tank. That is, the velocity of coolant flow varies considerably from one flow tube to the next. This nonuniformity of flow causes a decrease in the overall thermal performance, i.e., heat dissipation, of the heat exchanger, and perhaps more importantly is the direct cause of accelerated erosion in the flow tubes.

The prior art as attempted to solve the erosion problem and nonuniform flow problem by staking a solid, sheet-like baffle plate within the inlet tank, perpendicular to the flow axis of the inlet port, to prevent impingement of the incoming fluid flow directly on the flow tubes adjacent the flow axis of the inlet port. In FIG. 1, such a prior art heater core is generally shown at 10 including the typical tubular inlet port 12, inlet tank 14, flow tubes 16, outlet tank 18, and outlet port 20. The baffle plate is generally indicated at 22 and shown disposed directly over at least one flow tube 16. Therefore, fluid flow entering the inlet tank 14 is directed away from the flow tube 16 directly beneath the baffle plate 22, thereby accelerating erosion in this flow tube 16, as well as any other flow tubes 16 which experience a diminished coolant flow rate due to the baffle plate 22, and, because the heater core 10 shown in FIG. 1 causes a significant nonuniformity in the flow rate of fluid through the various flow tubes 16, the thermal efficiency of the heater core 10 is retarded.

The highest fluid flow rate occurs in the flow tube or tubes 16 located adjacent the partition wall 24 dividing the inlet tank 14 and the outlet tank 18. This is because the high temperature fluid entering the inlet tank 14 strikes the staked-in baffle plate 22 directly in front of certain eclipsed flow tubes 16. This splits the incoming high temperature fluid flow into two streams of substantially equal momentum. As viewed from the drawing of FIG. 1, the stream directed toward the right contacts the partition wall 24 giving up its momentum upon impact. This results in a relatively high flow through the flow tubes 16 located adjacent the partition wall 24. The stream directed toward the left end wall 26 of the inlet tank 14, on the other hand, generally does not encounter such a momentum reducing obstruction because the left end wall 26 is shaped to more efficiently direct the flowing fluid into the adjacent flow tubes 16, thus resulting in a progressive reduction in the fluid flow momentum. Therefore, by the time the stream directed leftward of the baffle plate 22 impacts the left end wall 26, its momentum is not as high as that of the stream directed rightwardly toward the partition wall 24. Consequently, the flow rate in the flow tubes 16 adjacent the left end wall 26 is not as high as that in the flow tubes 16 adjacent the partition wall 24. However, the flow rate in the flow tubes 16 directly adjacent the left end wall 26 is higher than the flows in the several next rightwardly adjacent flow tubes 16 due to the loss of momentum at the left end wall 26 which is translated into increased flow through the flow tubes 16 directly adjacent the left end wall 26.

Another prior art attempt to diminish the erosion problem is shown in U.S. Pat. No. 5,000,259 to Forrest, issued Mar. 19, 1991 and assigned to the assignee of the subject invention. The Forrest patent discloses a heater core having a greater number of tubes in the inlet pass than in the outlet pass. Thus, the overall velocity of coolant flow through the inlet tubes is reduced with an accompanying decline in the rate of inlet tube erosion. However, the overall velocity through the outlet tubes is higher than that through the inlet tubes leading to non-uniform erosion of tubes. Although effective, this method is costly in high production quantities and somewhat sacrificial of thermal transfer performance.

Hence, an improved heater core construction is needed wherein the flow rate through the various flow tubes 16 is more closely patterned to an ideal equivalent flow rate among the various flow tubes 16 so that the overall thermal performance may be enhanced and the occurrence of erosion reduced.

SUMMARY OF THE INVENTION AND ADVANTAGES

The subject invention contemplates a heat exchanger assembly for dissipating heat energy from a circulated fluid. The assembly comprises an inlet port centered along a flow axis for receiving high temperature fluid from a heat source, an inlet tank, having a predetermined height and a predetermined length and at least one wall spaced from the flow axis for receiving high temperature fluid from the inlet port, a plurality of flow tubes extending from the inlet tank for dissipating heat energy from the fluid, an outlet tank for receiving low temperature fluid from the flow tubes, and an outlet port extending from the outlet tank for returning the low temperature fluid to the heat source. The improvement of the subject invention comprises an inlet baffle plate disposed angularly within the inlet tank and including at least one perforation therein and having a minimum length and a net surface area and an angular orientation in the inlet tank determined according to the formula:

$$k = \frac{h}{2t}\left[\frac{x}{s} - \left(1 - \frac{t}{s}\right)\sin\theta\right]$$

Where: k = the ratio of the surface area of the perforations in the inlet baffle plate to the gross surface area of the inlet baffle plate; h = one half of the inlet tank height; t = one half of the minimum inlet baffle plate length; x = the distance between the flow axis and the partition wall; s = one half of the inlet tank length; and $\theta$ = the angle between the flow axis and the inlet baffle plate.

The subject invention orients the perforated inlet baffle plate angularly in the inlet tank and determines the length and surface area dimensions of the inlet baffle plate according to the above formula. When fixed in accordance with the mathematical relationship of the above formula, a heat exchanger provides substantially uniform flow rates of high temperature fluid through the various flow tubes. This, in turn, results in optimal overall thermal performance and also substantially reduces erosion in the flow tubes.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
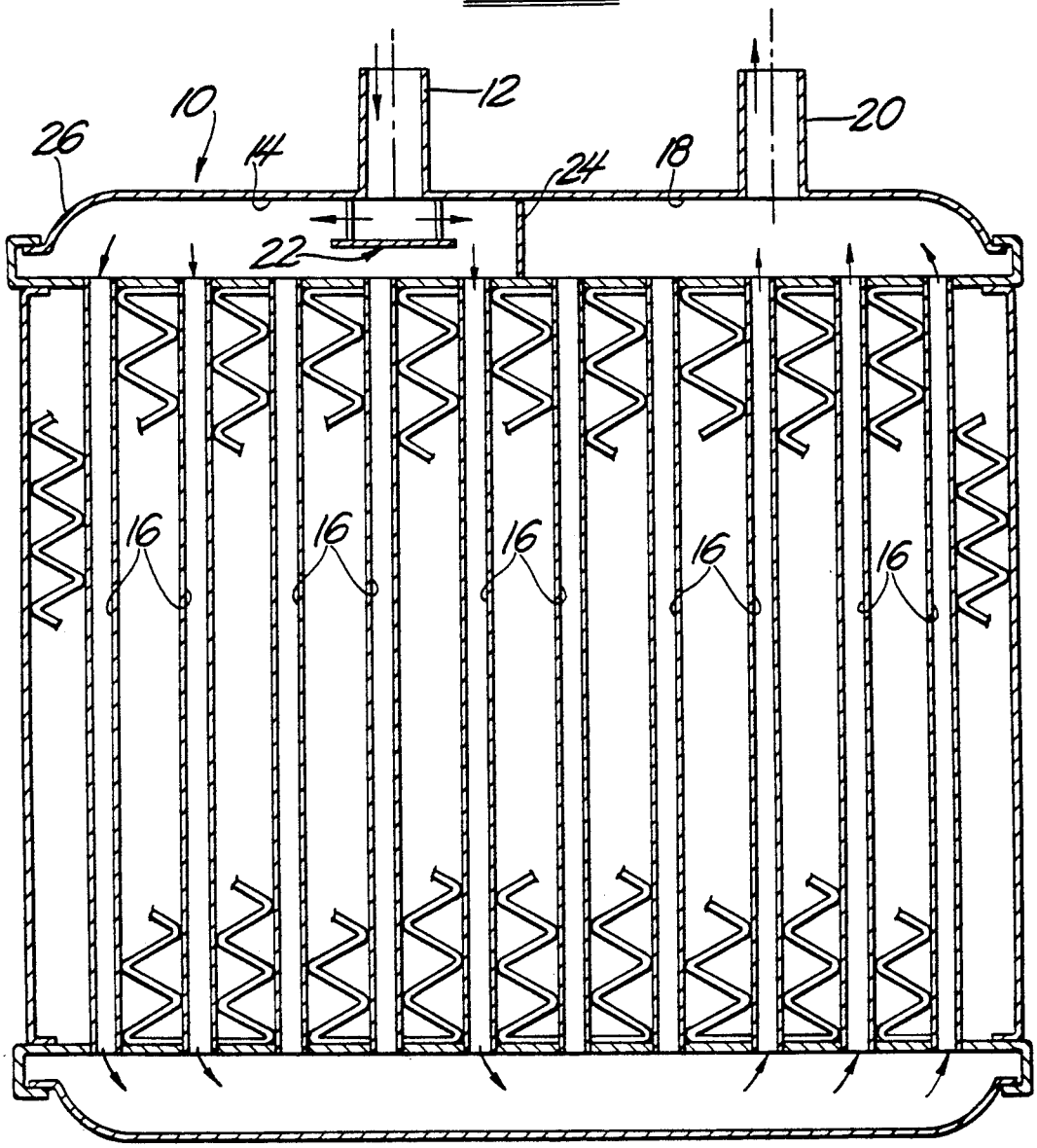
FIG. 1 is a simplified cross-sectional view of a heater core of the prior art construction.
Figure 2:
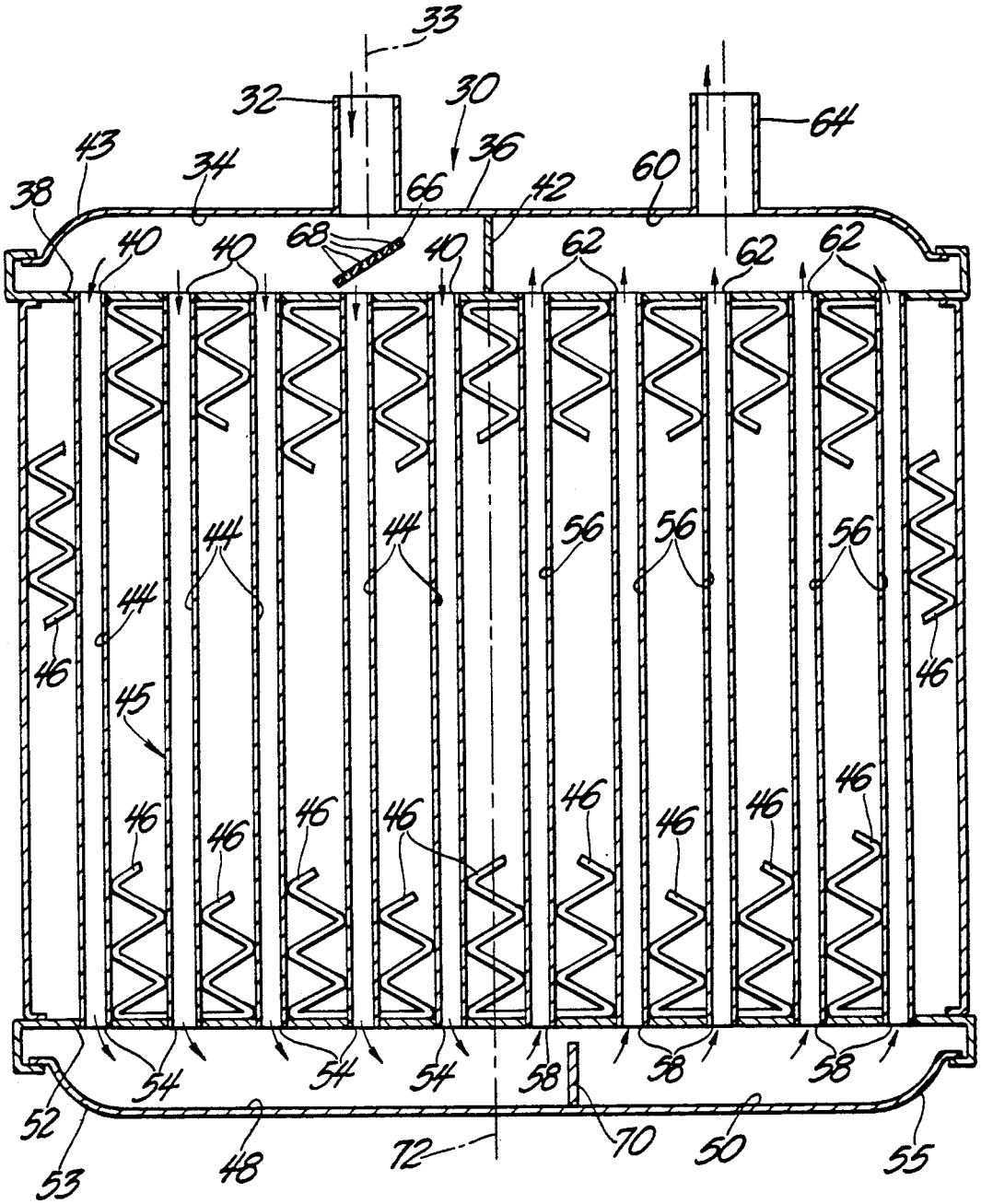
FIG. 2 is a heater core as in FIG. 1 incorporating the inlet baffle plate and return baffle plate of the subject invention.
Figure 3:
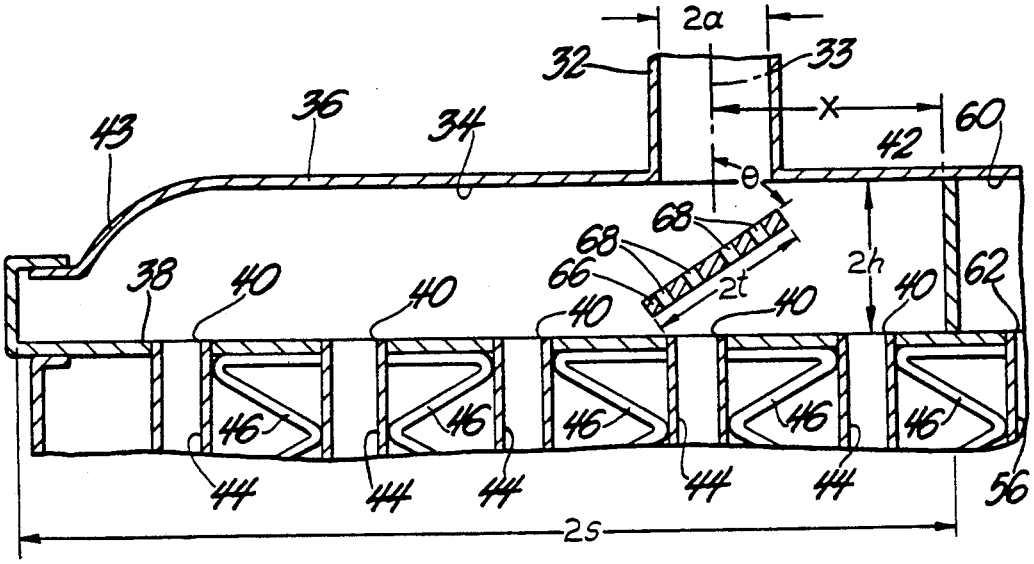
FIG. 3 is an enlarged fragmentary view of the inlet tank shown in FIG. 2.
Figure 4:
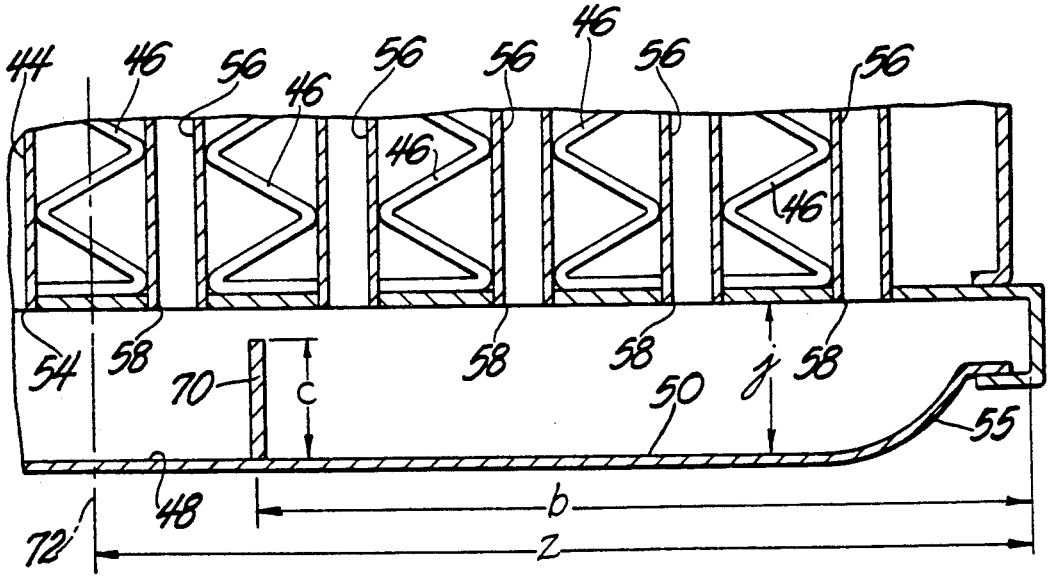
FIG. 4 is an enlarged fragmentary view of the return tank shown in FIG. 2.

Referring to FIGS. 2–4, a heat exchanger assembly of the type for dissipating heat energy from a circulated fluid is generally shown at 30. In the preferred embodiment illustrated in the Figures, the heat exchanger assembly 30 comprises a heater core which, in automotive applications, is disposed on the passenger compartment side of the fire wall. The heater core 30 receives high temperature liquid coolant from an engine block (not shown) and subsequently delivers low temperature liquid coolant back to the engine block. An adjustable fan (not shown) circulates air through the heater core 30 to heat the passenger compartment.

The heater core 30 includes a tubular inlet port 32 centered along a flow axis 33 for receiving high temperature fluid, i.e., coolant, from a heat source such as an automotive engine. The inlet port 32 is structured for convenient connection to a flexible heater hose (not shown), which in turn is connected to the coolant flow passages in the engine block.

An inlet tank 34 communicates with the inlet port 32 for receiving high temperature fluid from the inlet port 34. The inlet tank 34 has a thin metallic or plastic exterior upper housing 36 and an inlet/outlet header 38. A plurality of openings 40 are disposed in the inlet/outlet header 38 to create a manifold effect. A wall, and more particularly a partition wall 42 extends perpendicularly between the upper housing 36 and the inlet/outlet header 38 to separate the inlet tank 34 from an outlet tank 60 on the right side, as viewed from FIGS. 2 and 3. On the left side, the upper housing 36 includes a curved left end wall 43 adjoining the inlet/outlet header 38. A simple interlocking flange and lip arrangement serve to interconnect the inlet/outlet header 38 and the upper housing 36, with a gasket (not shown) being provided at their common juncture to effect sealing. The distance between the partition wall 42 and the left end wall 43 comprises a predetermined length of the inlet tank 34. The distance between the upper housing 36 and the inlet/outlet header 38 comprises a predetermined height of the inlet tank 34. This predetermined height is substantially constant from the partition wall 42 leftwardly to the beginning curvature of the left end wall 43, as viewed from FIG. 2.

A plurality of flow tubes, generally indicated at 45 in FIG. 2, extend parallel to one another from the inlet tank 34 to receive high temperature fluid from the inlet tank 34. The flow tubes 45 function to dissipate heat energy from the high temperature fluid. The flow tubes 45 are divided to include a plurality of inlet flow tubes 44. Each of the inlet flow tubes 44 adjoin the inlet tank 34 at the openings 40 provided in the inlet/outlet header 38. In this manner, all high temperature fluid exiting the inlet tank 34 is divided between the plurality of inlet flow tubes 44. Cooling fins 46 are provided in the form of corrugated sheet-metal strips brazed between adjacent inlet flow tubes 44 for enhancing heat transfer between the high temperature fluid and the passenger compartment air flowing between the inlet flow tubes 44.

Each of the inlet flow tubes 44 terminate at a return tank 48. In the preferred embodiment, however not necessarily, the return tank 48 has an end-to-end length twice the predetermined end-to-end length of the inlet tank 34. The return tank 48, as with the inlet tank 34, includes a housing portion 50 spaced a predetermined height from a generally parallel return header 52. The housing portion 50 includes a curved left end wall 53 and a curved right end wall 55. A simple interlocking flange and lip arrangement serve to interconnect the return header 52 and the lower housing 50, with a gasket (not shown) providing a fluid tight seal at their common juncture. The leftward half of the return header 52 is provided with a plurality of openings 54 for receiving the inlet flow tubes 44. In this manner, the inlet flow tubes 44 adjoin the return tank 48 by mating connection within the openings 54 of the return header 52. A brazed joint securely and without leakage couples the inlet flow tubes 44 to the return tank 48.

Hence, high temperature fluid entering the inlet port 32 is directed into the inlet tank 34 and then divided between the plurality of inlet flow tubes 44. Upon entering the return tank 48, the somewhat cooled fluid is redirected into a remaining portion of the flow tubes 45. This remaining portion of the flow tubes 45 comprises a plurality of outlet flow tubes 56. The outlet flow tubes 56 are disposed parallel to the inlet flow tubes 44 and adjoin the rightward half of the return header 52 of the return tank 48 by brazed and sealed mating attachment within a corresponding plurality of openings 58 therein. In this manner, the return tank 48 is functionally divided into an inlet portion where the inlet flow tubes 44 supply coolant to the return tank 48, and an outlet portion where the outlet flow tubes 56 carry coolant away from the return tank 48. The inlet and outlet portions of the return tank 48 are divided by an imaginary line of demarcation 72 extending straight downwardly from the partition wall 42, as will be described in greater detail subsequently. Cooling fins 46 are disposed in corrugated fashion between the outlet flow tubes 56 to enhance dissipation of heat energy in the coolant circulating therethrough.

The outlet flow tubes 56 emerge to deliver low temperature fluid to an outlet tank 60. The outlet tank 60 is defined by the same upper housing 36 as the inlet tank 34 and by the inlet/outlet header 38, and is therefore contiguous to the partition wall 42. Hence, the partition wall 42 effectively divides the inlet tank 34 from the substantially integrally formed outlet tank 60. Within the outlet tank 60, the inlet/outlet header 38 is provided with a plurality of openings 62 corresponding in number to the number of outlet flow tubes 56 for brazed, sealed connection to the outlet flow tubes 56. The outlet tank 60 thus receives low temperature fluid from the outlet flow tubes 56 to be returned to the heat source via a tubular outlet port 64.

For the purpose of improving the overall thermal performance of the heat exchanger assembly 30 and for decreasing the possibility of erosion in the flow tubes 45, the subject invention is provided with an inlet baffle plate 66 disposed angularly within the inlet tank 34 and having a minimum length and a net surface area and an angular orientation in the inlet tank determined according to the formula:

$$k = \frac{h}{2t}\left[\frac{x}{s} - \left(1 - \frac{t}{s}\right)\sin\theta\right]$$

Where as shown in FIG. 3, k=the ratio of the combined area of any perforations 68 in the inlet baffle plate 66 to the gross surface area of the inlet baffle plate 66; h=one half of the inlet tank 34 height; t=one half of the minimum baffle plate 66 length; x=the distance between the flow axis 33 and the partition wall 42; s=one half of the inlet tank 34 length; and $\theta$=the acute angle between the flow axis 33 and the inlet baffle plate 66.

The inlet baffle plate 66 and associated dimensional measurements are best shown in FIG. 3. In the preferred embodiment, the inlet baffle plate 66 is centered vertically, i.e., along the predetermined height, in the inlet tank 34 and also centered along the flow axis 33. Therefore, high temperature fluid entering the inlet tank 34 impinges the inlet baffle plate 66 and is efficiently and evenly distributed among all of the inlet flow tubes 44. The inlet baffle plate 66 is formed with a plurality of discrete perforations 68 therein through which high temperature fluid is permitted to pass. In the preferred embodiment, these perforations 68 are circular. Therefore, the net surface area of the inlet baffle plate 66 is comprised of the gross surface area of the inlet baffle plate 66 less the combined surface area of the perforations 68 in the inlet baffle plate 66. And from this, the ratio k of the combined area of the perforations 68 $A_o$ to the gross surface area of the inlet baffle plate 66 A can be calculated using the formula $$k = \frac{A_o}{A}$$

Therefore, the two above formulas can be integrated in the following manner:

$$\frac{A_o}{A} = \frac{h}{2t}\left[\frac{x}{s} - \left(1 - \frac{t}{s}\right)\sin\theta\right]$$

Where: A=the gross surface area of the inlet baffle plate 66; and $A_o$=the combined surface area of the perforations 68 in the inlet baffle plate 66.

The preferred method of implementing the present invention within the confines of the foregoing mathematical equations is as follows. First, prescribe the values for the diameter $2a$ of the inlet port 32, the inlet tank 34 height $2h$, the inlet tank 34 length $2s$, and the distance x between the flow axis 33 and the partition wall 42. Usually, these values are dictated by the packaging constraints in the HVAC module, i.e, the heater core 30 compartment in the automobile, and also dictated by the coolant flow requirements. Next, with the prescribed values for the distance x between the flow axis 33, the partition wall 42, and the length $2s$ of the inlet tank 34, the baffle angle $\theta$ is determined from the formula $$\theta = \arcsin\left(\frac{x}{s}\right)$$

With the baffle angle $\theta$ determined, the next step is to determine the minimum inlet baffle plate 66 length $2t$ using the equation $$t = \frac{a}{\sin\theta}$$

where a equals the radius of the inlet port 32.

As stated above, the minimum inlet baffle plate 66 length $2t$ is a minimum length which should be strictly observed as a minimum, or else some incoming flow of coolant will impinge directly on the inlet flow tubes 44 disposed below the inlet port 32. Next, the selected inlet tank height $2h$ should be selected according to the formula $$2h > 2a(\tan\theta)$$

If the inlet tank height $2h$ is selected to be equal to or less than the quantity of the equation above, coolant flow toward the partition wall 42 will not occur.

With these values, the fraction of the perforated to gross inlet baffle plate 66 surface area $A_o/A$ is determined from the equation $$k = \frac{h}{2t}\left[\frac{x}{s} - \left(1 - \frac{t}{s}\right)\sin\theta\right]$$

Knowing the value of k and the gross surface area A of the inlet baffle plate 66, the individual perforation 68 hole size and number of perforations 68 in the inlet baffle plate 66 can be directly determined using the equation $A_o = kA$ In considering the foregoing relationships, it is assumed that the flow axis 33 of the inlet port 32 is disposed more closely to the partition wall 42 than to the left end wall 43 of the inlet tank 34. However, if the packing constraints of the heater core 30 cause the inlet port 32 to be disposed more closely to the left end wall 43 of the inlet tank 34 than to the partition wall 42, the above mathematical equations remain valid with the understanding that the inlet baffle plate 66 must now be tilted toward the partition wall 42 rather than away from the partition wall 42. Also, the distance x which was previously designated as the distance between the flow axis 33 and the partition wall 42 must be redefined as the distance between the flow axis 33 and the left end wall 43 of the inlet tank 34.

The subject heater core 30 also includes a return baffle plate 70 disposed in the return tank 48 and spaced from the right end wall 55 of the return tank 48 a predetermined distance and having a predetermined height calculated by the formula $$\frac{b}{z} = \frac{40L^3(1-L)^3}{1 - 8L + 28L^2 - 40L^3 + 40L^4}$$

where: b = the spacing between the return baffle plate 70 and the right end wall 55; z = the perpendicular spacing between the partition wall 42 and the right end wall 55 in the return tank 48, i.e., the length of the outlet portion of the return tank 48; and L = the ratio of the return baffle plate 70 height c to the return tank 48 height j.

The variable z, however, is perhaps more accurately defined by designating a demarcation line 72 as shown in FIG. 4. In the preferred embodiment, the demarcation line 72 is aligned with the partition wall 42, but, in some instances, such alignment is not necessary. The demarcation line 72 is more precisely defined as the imaginary line extending midway between the rightwardmost inlet flow tube 44 and the leftwardmost outlet flow tube 56. Hence, the demarcation line 72 divides the inlet portion of the return tank 48 from the outlet portion thereof.

In the preferred embodiment, the return baffle plate 70 is unperforated, i.e., solid, because the incorporation of a perforated return baffle plate 70 by the typical plastic molding process would be difficult. Therefore, it is most convenient to incorporate an unperforated return baffle plate 70 formed in the return tank 48 in much the same molding manner as the partition wall 42. However, if the return tank 48 is fabricated from metal, then a perforated return baffle plate 70 may be easily welded in place therein.

EXAMPLE 1

By way of illustration, this example and the following two examples are presented to demonstrate the application of the foregoing mathematical equations in designing a high performance heater core 30 for automotive or similar applications.

Assuming the packaging constraints in a given HVAC module of an automotive air conditioning system are known in advance, the inlet baffle plate 66 geometric configuration can be determined. Therefore, the exemplary given values are:

$2a = 1.00$ inch = the of the inlet port 32;

$2h = 1.25$ inches the height of the inlet tank 34;

$2s = 4.00$ inches = the length of the inlet tank 34;

$x = 1.50$ inches = the distance between the flow axis 33 and the partition wall 42; and $A = 1.50$ square inches the gross surface area of the inlet baffle plate 66.

From these dimensions, the following quantities can be determined: the inlet baffle plate 66 angle $\theta$, the minimum inlet baffle plate 66 length $2t$, the ratio of the combined area of the perforations 68 in the inlet baffle plate 66 $A_o$ to the gross surface area A of the inlet baffle plate 66, and the diameter of the perforations 68 in the inlet baffle plate 66 if a perforation density of 10 perforations per square inch is to be maintained.

Substituting $x = 1.50$ inches and $2s = 4.00$ inches into the equation $$\theta = \arcsin\left(\frac{x}{s}\right)$$

it is determined that $\theta = 48.59°$. Next, introducing $2a = 1.00$ inch and $\theta = 48.59°$ into the equation $$t = \frac{a}{\sin\theta}$$

it is determined that $2t = 0.75$ inches. Next, inserting $h = 0.625$ inches, $t = 0.375$ inches, $x = 1.50$ inches, $s = 2.00$ inches, and $\theta = 48.59°$ into the equation $$k = \frac{h}{2t}\left[\frac{x}{s} - \left(1 - \frac{t}{s}\right)\sin\theta\right]$$

is determined that $k = 0.11719$. This means that 11.719 percent of the inlet baffle plate 66 surface area must be perforated. Because the gross surface area A equals 1.5 square inches and a perforation density of 10 holes per square inch is to be maintained, the inlet baffle plate 66 will include a total of 15 perforations 68. Therefore, using the formula $A_o = kA$ it is determined that the combined surface area of perforations 68 in the inlet baffle plate 66 equals 0.175786 square inches. Therefore, the area of each perforation is 0.175786 divided by 15, or 0.011719 square inches. And, applying the well known formula for the area of a circle $$A_p = \frac{\pi D_p^2}{4}$$

where $A_p$ = the area of one circular perforation 68, and $D_p$ = diameter of each perforation 68, the diameter of each perforation 68 is determined to be 0.1222 inches.

As a simple check, it should be verified whether the particular selection of the dimensions $2a$ (inlet port 32 diameter) and $2h$ inlet tank 34 height are compatible with the computed value of $\theta$ so as to permit flow of the coolant toward the partition wall 42. Working backwards, with $\theta$ equal to 48.59° and $2a$ equal to 1.00 inch, the equation $2h > 2a(\tan\theta)$ requires that $2h$ be greater than 1.1339 inches to ensure that coolant flow toward the partition wall 42 will occur. As the prescribed value of $2h=1.25$ inches is greater than the calculated value of 1.1339 inches, the given values of $2a$ and $2h$ in conjunction with the computed value of $\theta$ will not preclude the desired coolant flow toward the partition wall 42.

EXAMPLE 2

Assuming the given packaging constraints in an HVAC module of an automotive air conditioning system include the height j of the return tank 48 equal to 1.25 inches and the length z of the outlet portion of the return tank 48 equal to 4.00 inches, calculate the height of an unperforated return baffle plate 70 which is to be located a distance of 2.50 inches from the right end wall 55 of the return tank 48.

Therefore, inserting the values b=2.50 inches, j=1.25 inches, and z=4.00 inches into the equation $$\frac{b}{z} = \frac{40L^3(1-L)^3}{1-8L+28L^2-40L^3+40L^4}$$

the resulting polynomial solved for L equals 0.4335. And, because L equals the ratio of the return baffle plate 70 height c to the return tank 48 height j, the following relationship $$L = \frac{c}{j}$$

can be solved for c, i.e., the return baffle plate 70 height. Accordingly, c equals 0.5419 inches.

EXAMPLE 3

In a situation similar to Example 2 above, calculate the location of a return baffle plate 70 within the outlet portion of the return tank 48 when the height j of the return tank 48 equals 1.25 inches and the length z of the outlet portion of the return tank 48 equals 4.00 inches and the vertical height c of the unperforated return baffle plate 70 equals 0.625 inches. Hence, given c=0.625 inches, j=1.25 inches, and z=4.00 inches, the ratio L can be determined using the equation $$L = \frac{c}{j}$$

Solved for L, it is determined that L=0.5. Thus, introducing L=0.5 and z=4.00 inches into the equation $$\frac{b}{z} = \frac{40L^3(1-L)^3}{1-8L+28L^2-40L^3+40L^4}$$

the value b is determined to equal 0.4167 inches. Thus, the return baffle plate 70 must be located 0.4167 inches from the right end wall 55 of the outlet portion of the return tank 48.

The various aspects of the subject heater core 30 are particularly advantageous in that the perforated inlet baffle plate 66 disposed at an acute angle relative to the flow axis 33 reduces the flow of coolant toward the partition wall 42 thereby lowering the fraction of total coolant flow flowing through the inlet flow tube 44 adjacent the partition wall 42. Also, the perforations 68 in the inlet baffle plate 66 feed the inlet flow tubes 44 eclipsed from the inlet port 32 by the inlet baffle plate 66. Further, by reducing the coolant flow toward the partition wall 42, the acutely angled inlet baffle plate 66 increases the flow toward the left end wall 43 in the inlet tank 34 thereby increasing the fraction of total flow through the inlet flow tubes 44 adjacent the left end wall 43. This, in turn, causes a uniform rate of coolant flow through the inlet flow tubes 44.

Further, the vertical unperforated return baffle plate 70 in the return tank 48 provides an obstruction to the flow of coolant in the vicinity of the centrally located outlet flow tubes 56, i.e., those flow tubes 56 disposed adjacent the demarcation line 72. This, in turn, causes the flow of coolant fluid to lose some of its momentum in the proximity in the return baffle plate 70 thereby forcing more coolant through the otherwise starved centrally located outlet flow tubes 56. Thus, the rate of coolant flow through all of the outlet flow tubes 56 approaches a uniform rate. This uniformity of flow increases the thermal efficiency of the heater core 30, and also reduces the occurrence of erosion in the flow tubes 45.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A heat exchanger assembly for dissipating heat energy from a circulated fluid, said assembly comprising:

an inlet port centered along a flow axis for receiving high temperature fluid from a heat source;

an inlet tank having a predetermined height and a predetermined length and at least one wall spaced from said flow axis for receiving high temperature fluid from said inlet port;

a plurality of flow tubes extending from said inlet tank for dissipating heat energy from the fluid;

an outlet tank for receiving low temperature fluid from said flow tubes;

an outlet port extending from said outlet tank for returning lower temperature fluid to the heat source;

and an inlet baffle plate disposed angularly within said inlet tank with respect to said flow axis and including at least one perforation therein, said inlet baffle plate having a minimum length and a gross surface area and an angular orientation in said inlet tank determined according to the formula $$k = \frac{h}{2t}\left[\frac{x}{s} - \left(1 - \frac{t}{s}\right)\sin\theta\right]$$

where: k=ratio of the surface area of said perforation to said gross surface area of said inlet baffle plate; h=one half of said inlet tank height; t=one half of said minimum inlet baffle plate length; x=the distance between said flow axis and said wall; s=one half of said inlet tank length; and $\theta$ = the acute angle between said flow axis and said inlet baffle plate.

2. A heat exchanger assembly for dissipating heat energy from a circulated fluid, said assembly comprising:

an inlet port centered along a flow axis for receiving high temperature fluid from a heat source;

an inlet tank having a predetermined height and a predetermined length and a partition wall spaced from said flow axis for receiving high temperature fluid from said inlet port;

a plurality of flow tubes extending from said inlet tank for dissipating heat energy from the fluid;

an outlet tank disposed contiguous said partition wall for receiving low temperature fluid from said flow tubes;

a return tank communicating with said flow tubes and disposed generally midway between said inlet tank said outlet tank for redirectly the direction of flow through said flow tubes;

an outlet port extending from said outlet tank for returning low temperature fluid to the heat source;

and an inlet baffle plate disposed angularly within said inlet tank with respect to said flow axis and including a plurality of discrete perforations therein, said inlet baffle plate having a minimum length and a gross surface area and an angular orientation in said inlet tank determined according to the formula $$\frac{A}{A_o} = \frac{h}{2t}\left[\frac{x}{s} - \left(1 - \frac{t}{s}\right)\sin\theta\right]$$

where: A = said gross surface area of said inlet baffle plate; $A_o$ = the combined area of said perforations in said inlet baffle plate; h = one half of said inlet tank height; t = one half of said minimum inlet baffle plate length; x = the distance between said flow axis and said partition wall; s = one half of said inlet tank length; and $\theta$ = the acute angle between said flow axis and said inlet baffle plate.

3. A heat exchanger assembly for dissipating heat energy from a circulated fluid, said assembly comprising:

an inlet port centered along a flow axis for receiving high temperature fluid from a heat source;

an inlet tank having a predetermined height and a predetermined length and a partition wall spaced from said flow axis for receiving high temperature fluid from said inlet port;

a plurality of flow tubes extending from said inlet tank for dissipating heat energy from the fluid;

an outlet tank disposed contiguous said partition wall for receiving low temperature fluid from said flow tubes;

a return tank communicating with said flow tubes and disposed generally midway between said inlet tank and said outlet tank for redirecting the direction of flow through said flow tubes;

an outlet port extending from said outlet tank for returning low temperature fluid to the heat source;

a return baffle plate disposed in said return tank;

and an inlet baffle plate disposed angularly within said inlet tank with respect to said flow axis and including a plurality of discrete perforations therein, said inlet baffle plate having a minimum length and a gross surface area and an angular orientation in said inlet tank determined according to the formula $$\frac{A}{A_o} = \frac{h}{2t}\left[\frac{x}{s} - \left(1 - \frac{t}{s}\right)\sin\theta\right]$$

where: A = said gross surface area of said inlet baffle plate; $A_o$ = the combined area of said perforations in said inlet baffle plate; h = one half of said inlet tank height; t = one half of said minimum inlet baffle plate length; x = the distance between said flow axis and said partition wall; s = one half of said inlet tank length; an $\theta$ = the acute angle between said flow axis and said inlet baffle plate.

4. A heat exchanger assembly for dissipating heat energy from a circulated fluid, said assembly comprising:

an inlet port centered along a flow axis for receiving high temperature fluid from a heat source;

an inlet tank having a predetermined height and a predetermined length and at least one partition wall spaced from said flow axis for receiving high temperature fluid from said inlet port;

a plurality of flow tubes extending from said inlet tank for dissipating heat energy from the fluid;

an outlet tank disposed contiguous said partition wall for receiving low temperature fluid from said flow tubes;

a return tank having a predetermined height and extending between a left end wall adjacent a flow tube inlet portion thereof and a right end wall adjacent a flow tube outlet portion thereof;

a return baffle plate disposed in said return tank and spaced from said right end wall of said return tank a predetermined distance and having a predetermined height determined according to the formula $$\frac{b}{z} = \frac{40L^3(1 - L)^3}{1 - 8L + 28L^2 - 40L^3 + 40L^4}$$

where: b = the spacing between said return baffle plate and said right end wall; z = the perpendicular spacing between said right end wall of said return tank and said partition wall; and L = the ratio of said return baffle plate height to said return tank height;

an outlet port extending from said outlet tank for returning low temperature fluid to the heat source;

and an inlet baffle plate disposed angularly within said inlet tank with respect to said flow axis and including a plurality of discrete perforations therein, said inlet baffle plate having a minimum length and a gross surface area and an angular orientation in said inlet tank determined according to the formula $$\frac{A}{A_o} = \frac{h}{2t}\left[\frac{x}{s} - \left(1 - \frac{t}{s}\right)\sin\theta\right]$$

where: A = said gross surface area of said inlet baffle plate; $A_o$ = the combined area of said perforations in said inlet baffle plate; h = one half of said inlet tank height; t = one half of said minimum inlet baffle plate length; x = the distance between said flow axis and said partition wall; s=one half of said inlet tank length; and $\theta$=the acute angle between said flow axis and said inlet baffle plate.

5. A heat exchanger assembly for dissipating heat energy from a circulated fluid, said assembly comprising:

an inlet port centered along a flow axis for receiving high temperature fluid from a heat source;

an inlet tank for receiving high temperature fluid from said inlet port;

a plurality of inlet flow tubes extending from said inlet tank for dissipating heat energy from the fluid;

an outlet tank;

a plurality of outlet flow tubes extending from said outlet tank;

an outlet port extending from said outlet tank for returning low temperature fluid to the heat source;

a return tank communicating with said inlet flow tubes and said outlet flow tubes, said return tank having a predetermined height and extending between a left end wall adjacent said inlet flow tubes and a right end wall adjacent said outlet flow tubes with a demarcation line between said inlet flow tubes and said outlet flow tubes;

and a return baffle plate disposed in said return tank and spaced from said right end wall of said return tank a predetermined distance and having a predetermined height determined according to the formula $$\frac{b}{z} = \frac{40L^3(1-L)^3}{1-8L+28L-40L^3+40L^4}$$

where: b=the spacing between said return baffle plate and said right end wall; z=the spacing between said right end wall of said return tank and said demarcation line; and L=the ratio of said return baffle plate height to said return tank height.

* * * * *